US010746395B2

(12) United States Patent
Meissner et al.

(10) Patent No.: US 10,746,395 B2
(45) Date of Patent: Aug. 18, 2020

(54) ANGLED MAIN BURNER

(71) Applicant: Siemens Aktiengesellschaft, Munich (DE)

(72) Inventors: Andreas Meissner, Trebsen/Mulde (DE); Dietmar Degenkolb, Freiberg (DE); Thomas Fleischer, Dresden (DE); Matthias Köhler, Freiberg (DE)

(73) Assignee: Siemens Aktiengesellschaft, Munich (DE)

( * ) Notice: Subject to any disclaimer, the term of this patent is extended or adjusted under 35 U.S.C. 154(b) by 39 days.

(21) Appl. No.: 15/781,715

(22) PCT Filed: Dec. 12, 2016

(86) PCT No.: PCT/EP2016/080670
§ 371 (c)(1),
(2) Date: Jun. 6, 2018

(87) PCT Pub. No.: WO2017/108484
PCT Pub. Date: Jun. 29, 2017

(65) Prior Publication Data

US 2018/0363895 A1 Dec. 20, 2018

(30) Foreign Application Priority Data

Dec. 22, 2015 (DE) ..... 10 2015 226 566

(51) Int. Cl.
*F23K 3/02* (2006.01)
*F23C 5/32* (2006.01)
(Continued)

(52) U.S. Cl.
CPC ..... *F23C 5/32* (2013.01); *C10J 3/487* (2013.01); *C10J 3/506* (2013.01); *F23D 1/005* (2013.01);
(Continued)

(58) Field of Classification Search
CPC ..... C10J 3/506; C10J 3/485; C01B 3/363
See application file for complete search history.

(56) References Cited

U.S. PATENT DOCUMENTS 3,595,480 A * 7/1971 Kunioka ..... C21C 5/4606 239/132.3
4,647,294 A 3/1987 Jahnke et al.
(Continued)

FOREIGN PATENT DOCUMENTS

CN 1112537 C 6/2003
CN 102015971 A 4/2011
(Continued)

OTHER PUBLICATIONS

International Search Report dated Mar. 13, 2017, for PCT/EP2016/080670.

*Primary Examiner* — Jason Lau
(74) *Attorney, Agent, or Firm* — Beusse Wolter Sanks & Maire

(57) ABSTRACT

A gasification burner for a multiple-burner arrangement in an entrained-flow gasifier, in which the gasification burner extends along a main axis and in which the media for the gasification reaction in the gasification burner are guided in separate media channels and exit at the burner mouth in a direction having an angle to the main axis that is not zero. A vertical installation with an optimally adaptable flame shape is provided. Depending on the orientation of the burners, the flame shape is adaptable, whether it be a minimized total flame diameter for an initial slag formation of the cooling screen or an increase in the total twist of the total flame for an increased particle deposition on the reactor wall. The gasification burner with angled burner tips can be used as part of a retrofit.

4 Claims, 5 Drawing Sheets

(51) Int. Cl.

| | |
|---|---|
| ***C10J 3/48*** | (2006.01) |
| ***C10J 3/50*** | (2006.01) |
| ***F23D 1/00*** | (2006.01) |

(52) U.S. Cl.
CPC ..... *C10J 2200/152* (2013.01); *F23D 2201/20* (2013.01)

(56) References Cited

U.S. PATENT DOCUMENTS

| | | | | |
|---|---|---|---|---|
| 2008/0113309 | A1 | 5/2008 | Takashima et al. | |
| 2008/0141588 | A1* | 6/2008 | Kirchhubel ..... | C01B 3/363 48/77 |
| 2010/0107642 | A1 | 5/2010 | Bhaisora et al. | |
| 2011/0116987 | A1 | 5/2011 | Schulze et al. | |
| 2014/0227142 | A1 | 8/2014 | Chung et al. | |

FOREIGN PATENT DOCUMENTS

| | | | |
|---|---|---|---|
| CN | 103874748 | A | 6/2014 |
| DE | 102006059149 | A1 | 6/2008 |
| EP | 0976977 | A1 | 2/2000 |
| GB | 2136556 | A | 9/1984 |

* cited by examiner

ANGLED MAIN BURNER

CROSS REFERENCE TO RELATED APPLICATIONS

This application is the US National Stage of International Application No. PCT/EP2016/080670 filed Dec. 12, 2016, and claims the benefit thereof. The International Application claims the benefit of German Application No. DE 102015226566.8 filed Dec. 22, 2015. All of the applications are incorporated by reference herein in their entirety.

FIELD OF INVENTION

The invention relates to a gasification burner for a multiple-burner arrangement in an entrained-flow gasifier for operation with fuels in the form of dust or liquid fuels, at pressures between ambient pressure and 8 MPa and gasification temperatures between 1200 and 1900° C., and with a free oxygen-containing gasification medium.

BACKGROUND OF INVENTION

Use is made of gasification reactors with a cooling screen during entrained-flow gasification both with a single combination burner and with multiple single burners. In the case of a combination burner, with increasing reactor power, the mixing of fuel and oxygen becomes increasingly more difficult owing to the increasing gap widths. Consequently, multiple single burners are preferred for large reactors.

The arrangement of the single burners and the swirling of the gasification media when the latter exit at the burner mouth influence the flame shape and the conversion of the fuel, and also the reactor geometry required for this purpose.

Inclined single burners oriented toward the reactor center are advantageous for minimization of the reactor diameter and easier ignitability of the single burners by a centrally arranged pilot burner.

The generation of a direction of rotation of the total flame for optimizing the deposition of slag on the cooling screen wall is difficult in the case of multiple single burners due to the necessarily opposing direction of rotation of the media of adjacent single burners. Single burners which are positioned eccentrically can increase the angular momentum of the total flames.

An entrained-flow gasifier is known from DE 102006059149, in which multiple single burners are arranged so as to be inclined and eccentrically tilted.

The installation of obliquely arranged single burners becomes complicated with increasing reactor size and entails the risk of the burner being jammed or even deformed. Owing to these disadvantages, use has hitherto been made of vertically oriented and installable burners.

SUMMARY OF INVENTION

The invention is based on an object of specifying a structural configuration for a burner and an entrained-flow gasifier which combine the advantages of obliquely oriented burners with simple installability.

The object is achieved by a burner having the features of the claims.

The bulk of the gasification burner 1 according to the invention extends along a main axis 15, wherein the media for the gasification reaction in the gasification burner are guided in separate media channels 2, 3 and exit at the burner mouth in a direction 16 which has a non-zero angle 17 to the main axis 15. The gasification burner has a bend which brings about an oblique exit of the media, and thus an oblique gasification flame, with respect to the main axis of the gasification burner. That end of the gasification burner, having the burner mouth 22, which projects into the reaction chamber does not project beyond the tubular inner diameter of the burner seat 14. Even in the case of a vertically installed burner, an oblique exit of media is realized. The single burner is constructed such that, toward the burner mouth 22, the cross sections of the media channels 2, 3 are drawn in or tapered in order to set the desired exit speed. In order to keep the pressure losses small, the drawing-in/tapering is realized only shortly before the exit into the reaction chamber, and thus shortly before the burner mouth. The oblique exit of the media can be brought about by an asymmetric and oblique formation of the drawing-in/tapering. Depending on the positioning of the asymmetry and the angle of the bend, the single burner flame can be directed in a predefined direction to a greater or lesser extent. The configuration of the gasification burner according to the invention combines the advantages of vertical installation and improved flame shape in conventional, obliquely installed burners.

By rotation 24 of the single burners in their burner seats 14, an orientation for attaining a flame shape which is optimal for the currently desired purpose is possible without structurally changing the individual burners. The individual burners can be oriented in the pattern of the fastening bolts in the single-burner flange 14.

In one particular configuration of the invention, the gasification burners are arranged such that their respective media outlet axes 16 intersect the central axis 18 of the entrained-flow gasifier above the top edge of the raw-gas and slag outlet 6, in particular at a point. In this case, a structure-induced reduction of the diameter of the reactor is possible.

Orientation of the gasification burner flames 16 of the single burners 1 in the direction of the central axis 18 of the entrained-flow gasifier allows the extension of the total flame to be minimized and thus, for example for an initial slag formation, the thermal loading of the cooling screen 4 to be reduced.

Orientation of the single burners in the same sense about an angle 25, in the case of which orientation the media outlet axes and thus the respective directions of the gasification burner flames do not pass through an imaginary cylinder 23 about the central axis 18 of the entrained-flow gasifier, allows the swirl of the total flame and thus the deposition of solids on the cooling screen 4 to be intensified. Said arrangement entails a significant reduction in undesirable discharge of fine slag in the form of dust, which is difficult to use. The angle 25 can have a value between greater than zero and 30 degrees, in particular 15 degrees. The angle 25 can be predefined in the pattern of the fastening bolts of the burner in its burner seat 14.

In air-flow gasifiers which already exist, the gasification burner according to the invention with bent-off burner tip is able to be used with little effort as part of a retrofit.

In one particular configuration of the invention, a gasification burner is arranged in a separate burner flange 14. This embodiment is advantageous for an arrangement of the gasification burners with a bend at an angle 17 of 15 degrees and greater.

In one particular configuration of the invention, the gasification burners 1 and the ignition and pilot burner 13 are arranged in a common burner flange. This embodiment is advantageous for an arrangement of the gasification burners with a bend at an acute angle 17 close to zero degrees.

BRIEF DESCRIPTION OF THE DRAWINGS

The invention will be explained below, to an extent necessary for comprehension, as an exemplary embodiment on the basis of figures, in which.

Identical designations denote identical elements in the figures.

DETAILED DESCRIPTION OF INVENTION

Figure 6:
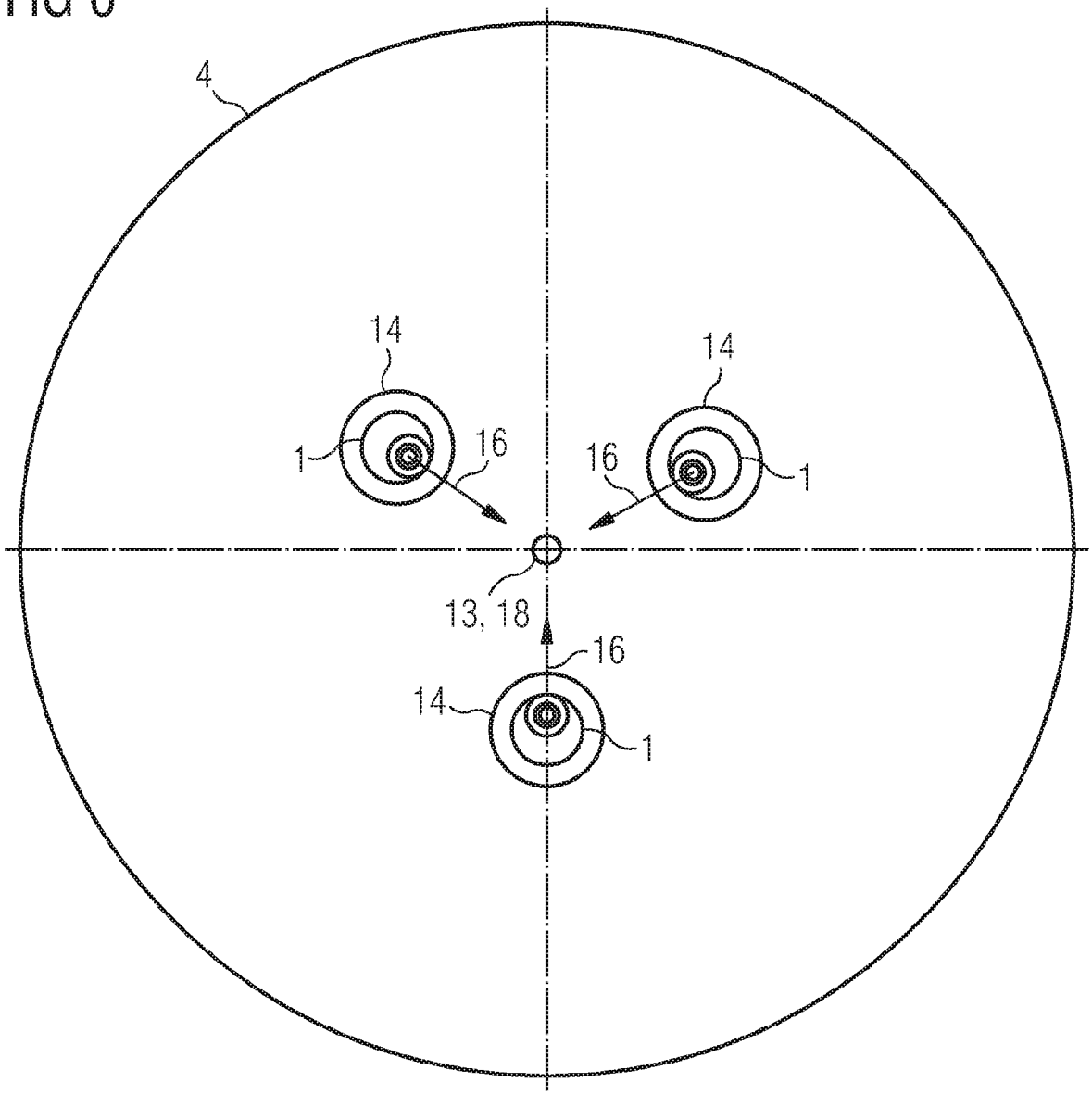
FIG. 6 shows a plan view for the arrangement and orientation of the gasification burners according to the invention with minimized total flame diameter.
Figure 7:
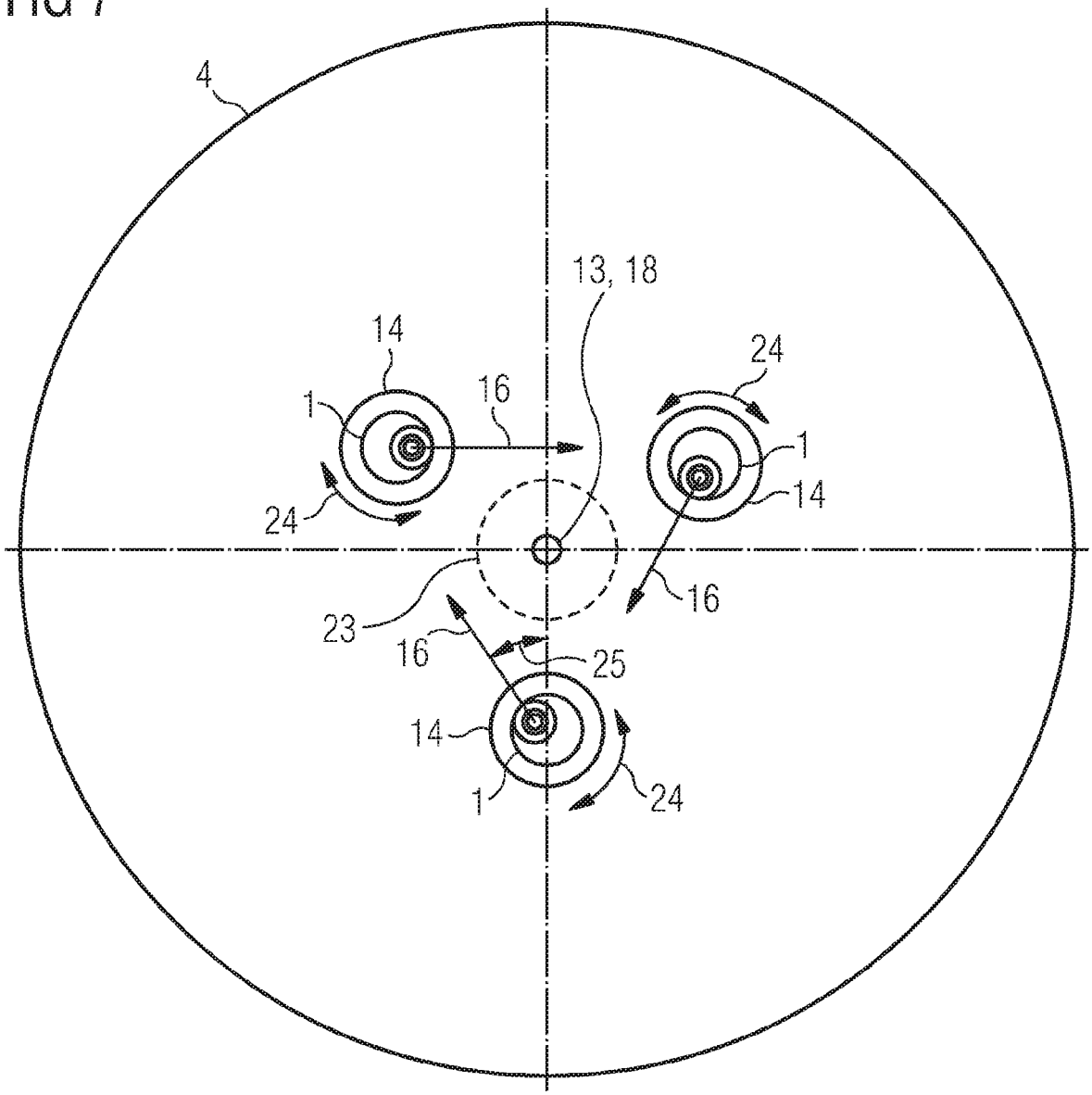
FIG. 7 shows a plan view for the arrangement and orientation of the gasification burners according to the invention with maximization of the total swirl.

In an entrained-flow reactor, 300 000 kg/h of coal dust 3 are converted by oxygen and steam 2 as a gasification medium to raw synthetic gas. The gasification temperature is 1450° C., and the gasification pressure is 4 MPa. Two or three gasification burners 1 are arranged on the head of the reactor. In the case of three gasification burners 1, these are arranged symmetrically about the central axis 18 with an angle offset of 120 degrees as illustrated in FIGS. 6 and 7. As fuel 3, coal dust is fed pneumatically as a coal dust conveying gas suspension to the gasification burners 1, and the conversion takes place in the gasification chamber 5, which is delimited by a cooling screen 4, wherein the cooling screen is formed by tubes which are welded in a gas-tight manner and through which cooling water flows. The hot gasification gas exits the gasification chamber 5 together with the liquid slag and passes through the raw-gas and slag outlet 6 into the quenching chamber 12, into which water is injected via the quenching nozzles 7 for the purpose of cooling raw gas and slag. The slag 11 is deposited in the water bath 8 and is discharged via the slag discharge 9. The quenched raw gas exits the quenching chamber 12 in a steam-saturated state via the raw-gas discharge 10 and passes into subsequent cleaning stages. The gasification burners 1 and the ignition and pilot burner 13 are guided into the gasification chamber 5 via respective single burner flanges 14. The ignition and pilot burner 13 is arranged vertically along the reactor axis, and the gasification burners 1 are arranged with their gasification burner axes 15 parallel to the reactor axis 18.

On the head of the reactor, an ignition and pilot burner 13 for fuel-gas operation is arranged along the reactor axis 18. It is also possible to integrate the ignition and pilot burner 13 into one or more gasification burners 1. This embodiment renders unnecessary a separate flange for the ignition and pilot burner.

The gasification burners 1 can be charged with fuels in the form of dust or with liquid fuels, wherein "liquid fuels" are also to be understood to mean suspensions of liquids, such as water or oil, with fuels reduced to a dust or inorganic additions.

Figure 1:
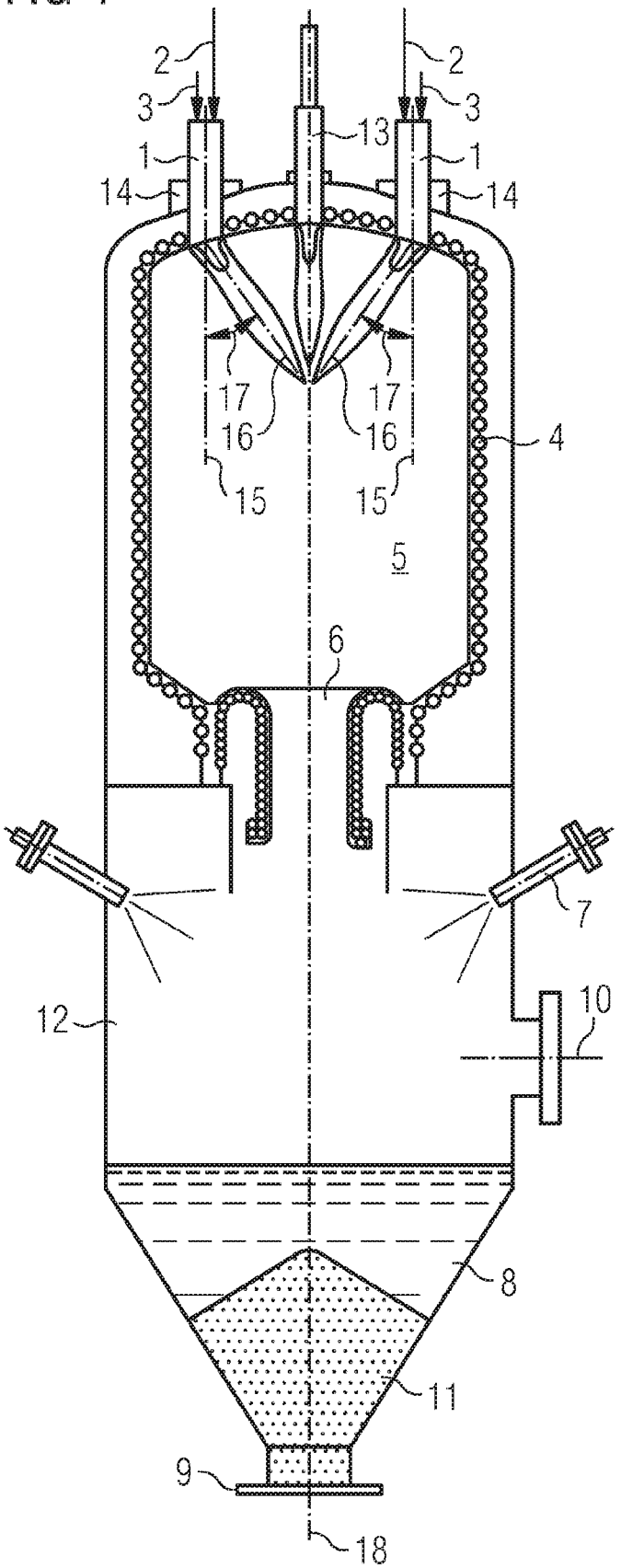
FIG. 1 shows an entrained-flow gasifier with multiple gasification burners according to the invention.
Figure 2:
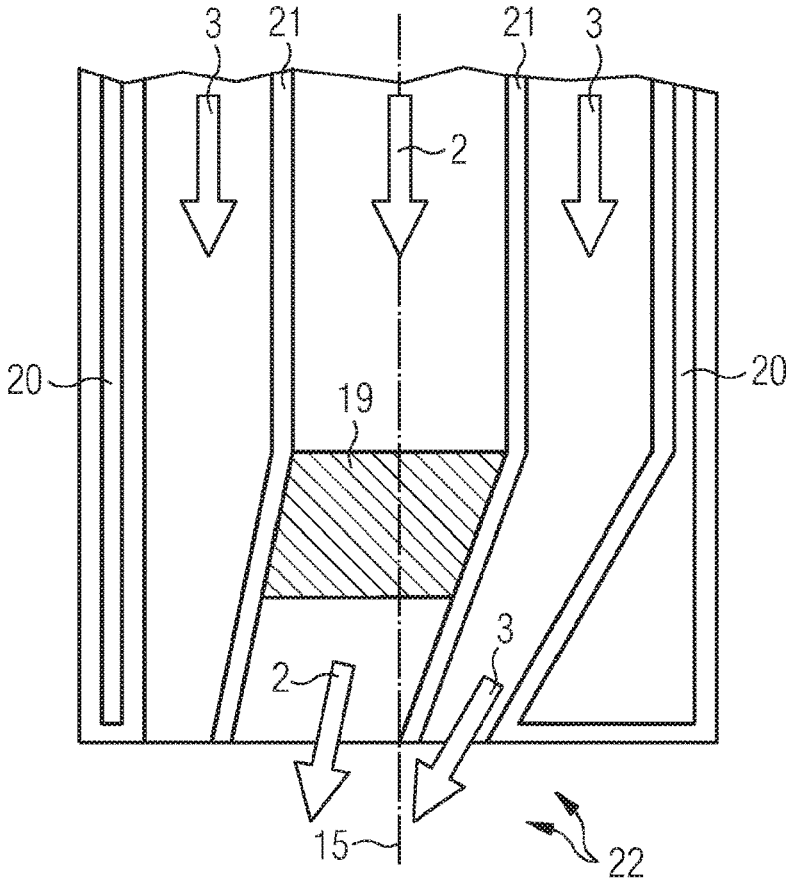
FIG. 2 shows a side section of a gasification burner according to the invention.

The gasification burner illustrated in FIG. 2 has a cylindrical outer contour about the main axis 15. An annular duct for the fuel 3 is arranged concentrically around a central gasification medium channel 2. It is also possible for the gasification medium channel 2 and the fuel channel 3 to be interchanged. The gasification medium channel 2 and the fuel channel 3, which are separated from one another by a separating wall 21, are, in the region of the burner tip, bent off in a direction 16 relative to the main axis 15 such that the exiting media and thus also the gasification burner flame has a non-zero angle 17 to the main axis 15. The angle can lie between 3 degrees and 30 degrees, advantageously 15 degrees. Arranged close to the burner mouth 22 in the gasification medium channel 2 is a swirl plate 19 which sets the outflowing gasification medium in rotation. When the gasification medium exits the burner, the fuel is drawn in and a fuel-gasification medium swirl is formed. A liquid cooling means 20 is arranged between the outer wall of the gasification burner and the outer media channel. The gasification burner according to the invention has a fastening flange (not illustrated), which permits pressure-tight installation in the burner seat 14 of the housing of the entrained-flow gasifier by means of fastening bolts.

Figure 3:
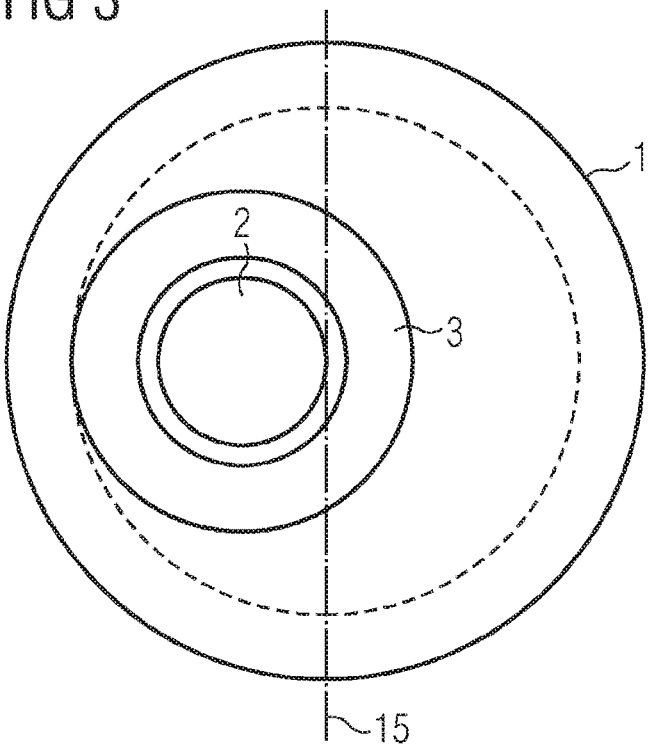
FIG. 3 shows a view of the burner mouth of the gasification burner as per FIG. 2.

FIG. 3 shows a view of the end face and of the burner mouth 22 of the gasification burner as per FIG. 2.

Figure 4:
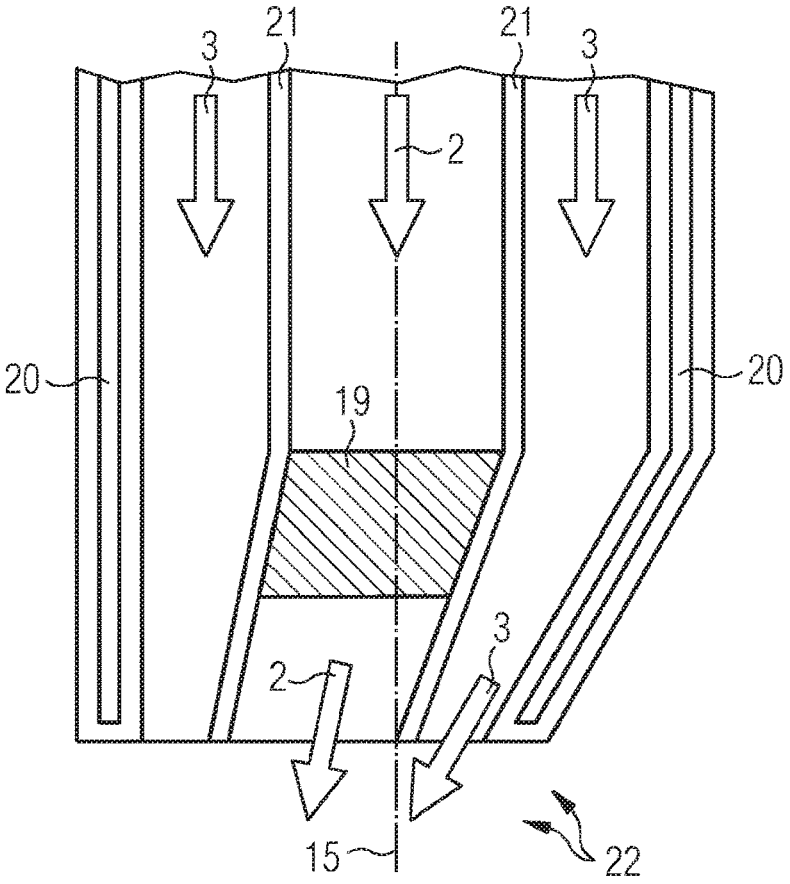
FIG. 4 shows a side section of a gasification burner according to the invention with a bent-off burner tip.

The gasification burner according to the invention as per FIG. 4 has, about the gasification burner axis 15, a tubular outer contour which, toward the burner tip, merges into a bent-off frustrum whose axis 16 is bent off by a non-zero angle 17 in relation to the gasification burner axis 15. The top surface of the frustrum forms the burner mouth. The burner tip is formed such that it does not project beyond the tubular outer contour.

Figure 5:
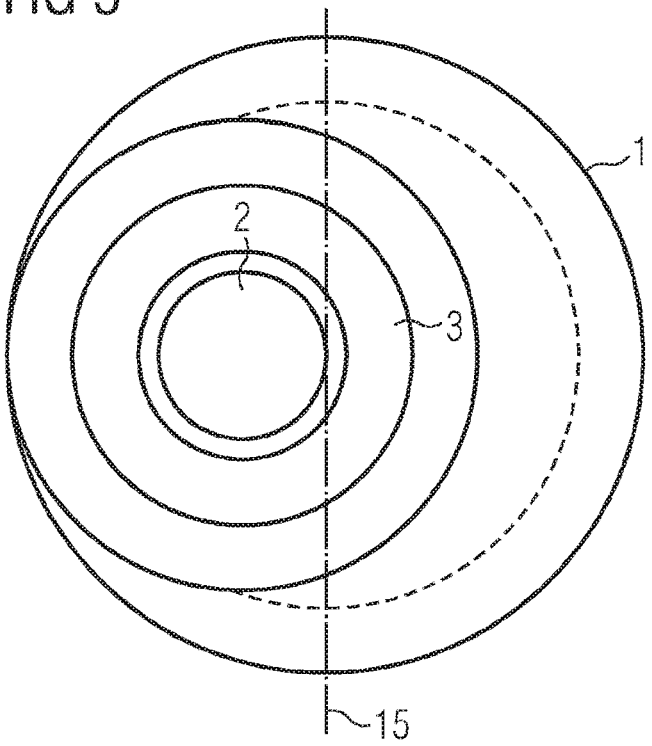
FIG. 5 shows a view of the burner mouth of the gasification burner as per FIG. 4.

FIG. 5 shows a view of the end face and of the burner mouth 22 of the gasification burner as per FIG. 4.

In the configuration of the gasification burner as per FIG. 4, a reduced surface of the burner is opposite the hot reaction chamber 5, as a result of which the thermal input into the burner is correspondingly reduced.

FIG. 6 shows an arrangement of three gasification burners whose respective media outlet direction 16 is oriented toward the central axis 18 of the entrained-flow gasifier. This orientation of the gasification burners results in a minimized total flame diameter. The ignition and pilot burner 13 is arranged along the central axis 18 of the entrained-flow gasifier.

FIG. 7 shows an arrangement of three gasification burners whose respective media outlet direction 16 pass the central axis 18 of the entrained-flow gasifier at a predefined distance. The gasification burners are arranged in their burner seat 14 so as to be rotated in the same sense such that their respective media outlet directions 16 form a tangent to an imaginary cylinder 23 about the central axis 18 of the entrained-flow gasifier. An angle 25 of the respective media outlet axes 16 to the central axis 18 of the entrained-flow gasifier is realized, which can lie between 3 degrees and 30 degrees, advantageously 15 degrees. In this arrangement, the gasification burner flames are crossed with respect to one another and the total swirl of the gasification burner flames is increased.

A burner according to the invention is also realized by a burner, the bulk of which is arranged concentrically with respect to a main axis 15 and in which the center of the burner mouth 22 is situated outside the main axis of the burner.

A burner according to the invention is also realized by a burner which has a fastening flange and in which the burner part between the fastening flange and the burner mouth is delimited by a tubular outer contour.

The burner according to the invention may also be referred to as a "bent-off burner" or as a "cross-eyed burner".

"Fuels" are to be understood to mean coals of different rank and cokes of different origin and even also combustible liquids having particular solids and ash contents and even also water, coal or oil-coal suspensions, so-called slurries.

LIST OF REFERENCE SIGNS

1. Gasification burner
2. Gasification medium, gasification medium channel
3. Fuel, fuel channel
4. Cooling screen
5. Gasification chamber
6. Raw-gas and slag outlet
7. Quenching nozzle
8. Water bath
9. Slag discharge
10. Raw-gas discharge
11. Slag deposit
12. Quenching chamber
13. Ignition and pilot burner with pilot flame
14. Single burner flange, burner seat
15. Gasification burner axis
16. Media outlet axis (direction of the gasification burner flame)
17. Angle of the media outlet axis 16 to the gasification burner axis 15
18. Central axis of the entrained-flow gasifier
19. Swirl plate
20. Liquid-cooled outer wall of the gasification burner
21. Gasification medium channel-fuel channel separating wall
22. Burner mouth
23. Imaginary cylinder about the central axis 18 of the entrained-flow gasifier
24. Gasification burner, rotatably oriented
25. Angle of the media outlet axis 16 to the central axis 18 of the entrained-flow gasifier

The invention claimed is:

1. A gasification burner for a multiple-burner arrangement in an entrained-flow gasifier, comprising:

a gasification burner;

a first media channel in the gasification burner and comprising a first channel straight portion leading to a frustum-shaped end portion in which a section of decreasing flow area terminates at a first media channel outlet, wherein a frustum main axis is different than a first channel straight portion main axis; and a second media channel in the gasification burner and comprising a second channel straight portion surrounding the first channel straight portion and an asymmetric tapered portion surrounding the frustum-shaped end portion in which a section of decreasing flow area terminates at a second media channel outlet.

2. The gasification burner as claimed in claim 1, wherein the gasification burner comprises a burner outlet that is the only burner outlet for the gasification burner.

3. The gasification burner as claimed in claim 2, wherein the first media channel outlet and the second media channel outlet terminate together at the burner outlet.

4. A gasification reactor, comprising:

a gasification chamber centered along a reactor axis;

a gasification burner comprising a burner outlet that is the only outlet for the gasification burner;

a first media channel in the gasification burner and comprising a first channel straight portion leading to a frustum-shaped end portion in which a section of decreasing flow area terminates at a first media channel outlet; and a second media channel in the gasification burner and comprising a second channel straight portion surrounding the first channel straight portion and an asymmetric tapered portion surrounding the frustum-shaped end portion in which a section of decreasing flow area terminates at a second media channel outlet;

wherein a main axis of the first channel straight portion is closer to parallel with the reactor axis than is a main axis of the frustum-shaped end portion;

wherein a main axis of the second channel straight portion is closer to parallel with the reactor axis than is a main axis of the asymmetric tapered portion; and wherein the frustum-shaped end portion and the asymmetric tapered portion both aim media radially inward into the gasification chamber.

* * * * *